United States Patent [19]

Kawasaki et al.

[11] 3,938,292

[45] Feb. 17, 1976

[54] PROCESS FOR REINFORCED CONCRETE WALL FORMING

[75] Inventors: Takato Kawasaki; Yuko Ikuta, both of Yokohama, Japan

[73] Assignee: Takenaka Komuten Company, Ltd., Japan

[22] Filed: June 29, 1971

[21] Appl. No.: 157,864

[30] Foreign Application Priority Data

July 2, 1970 Japan ..... 45-58168

[52] U.S. Cl. ..... 52/742; 52/169 R; 52/294

[51] Int. Cl.[2] ..... E04G 21/02

[58] Field of Search ..... 52/742, 260, 169, 743, 52/744, 294, 299, 295

[56] References Cited

UNITED STATES PATENTS

| | | | |
|---|---|---|---|
| 2,815,656 | 12/1957 | Klein | 52/169 |
| 3,197,964 | 8/1965 | Fehlmann et al. | 52/742 |
| 3,226,935 | 1/1966 | Schneller | 52/169 |
| 3,431,736 | 3/1969 | Ueda | 52/169 |
| 3,468,094 | 9/1969 | Campbell | 52/169 |
| 3,555,751 | 1/1971 | Thorgusen | 52/742 |

*Primary Examiner*—Frank L. Abbott
*Assistant Examiner*—Leslie W. Braun
*Attorney, Agent, or Firm*—Fidelman, Wolffe & Leitner

[57] ABSTRACT

A process for the production of reinforced concrete walls in trenches involving preparing a trench of at least unit length, placing a reinforcing cage in the trench, fixing further reinforcing so that it will extend past the end of the unit, placing means to prevent the concrete from completely covering the further reinforcing and pouring the concrete.

2 Claims, 22 Drawing Figures

INVENTOR

BY

ATTORNEY

INVENTOR

BY

ATTORNEY

INVENTOR

BY

ATTORNEY

INVENTOR

BY

ATTORNEY

INVENTOR

BY

ATTORNEY

INVENTOR

BY

ATTORNEY

INVENTOR

BY

ATTORNEY (A)

(B)

INVENTOR

BY

ATTORNEY

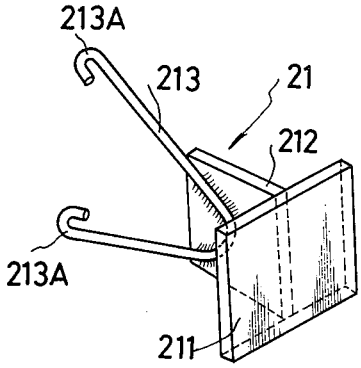
FIG.18
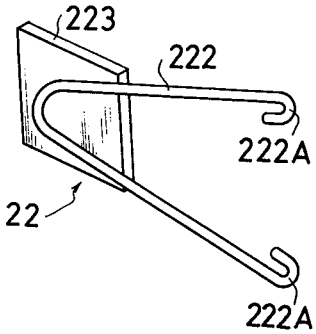
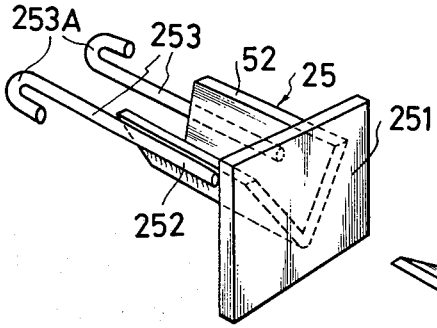
FIG.19
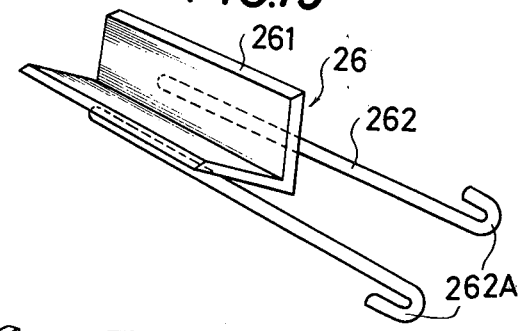
FIG.20
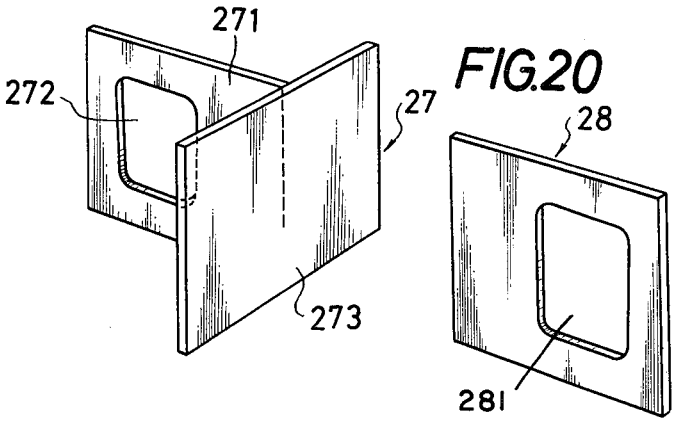
INVENTOR
BY
ATTORNEY

PROCESS FOR REINFORCED CONCRETE WALL FORMING

The present invention relates to an overall technical idea for the construction of concrete structures such as slurry trench walls and the like. More particularly, it relates to the overall technical idea involving a fundamental invention in which trenches for constructing walls are excavated in sections and concrete is poured into each unit wall separately. Shear connectors join the unit walls and protrude out of the surfaces of each unit which is to be joined to another unit, and the reinforcement of the unit walls overlaps the protruding shear connectors so as to provide strength in the concrete joint. Further, the invention relates to improved water cut-off between the joints of the unit walls and to the problem created by pouring concrete in sections, which requires preventing the concrete from flowing out of a unit after pouring.

Studies relating to quiet, vibration-free construction have been done recently. In order to render it possible to solve these problems, a slurry trench wall process has been developed. A characteristic of this process is the construction of concrete wall bodies which extend to a given depth along the building site where trenching is carried out. These wall bodies serve as cut-off walls or retaining walls and allow safe, economical construction. In slurry trench wall construction, the length of such unit is determined by careful consideration of the influence of soil pressure, stability of the unit, etc.

In such a process, a trench of a unit length is excavated, a reinforcement cage is inserted and concrete and muddy water are poured alternately. Due to the differences in time between pouring adjoining unit walls, and further due to the existence of bentonite slurry remaining between the joined surfaces of the units, bonding strength between the units is relatively low. Similarly, water cut-off, i.e., the preventing of seepage between the joined surfaces is also low. Also, the bentonite slurry sticks to the surface of the reinforcing and thus the adhesive bond between the concrete and the reinforcing is also poor. A current tendency is to utilize the slurry trench wall for a structural wall as it is, and thus, the wall bodies themselves must be strengthened and have good water cut-off characteristics.

The first essential feature of the present invention is the use of a locking box or other jig. Thereby, a bonding plate or other member for connecting unit walls protrudes out of the surfaces of the unit walls which are to be joined. The reinforcing of the next unit wall overlaps the protruding connectors and concrete is poured therein, so as to increase the bonding strength.

The second essential feature is the improving of water cut-off by the use of a flat sheet of steel with holes therein, or a member having an H-shape in cross-section as connector members.

The third essential feature is the use of a member for connecting the wall bodies, which member covers the whole trench width so as to function as a plate and prevent concrete from flowing out.

The fourth feature is controlling the pressure acting on the plate and locking box when concrete is poured into the prepared and stabilized unit wall body and its reinforcement. The concept is to lighten the burden on the locking box, etc. in disposition of the pressure, as well as to improve safety, stability and precision in concrete pouring.

A fifth feature is the provision of connection means which allow for construction of columns, beams, slabs, etc. attached to the previously constructed slurry trench wall or the like.

Further purposes and features of the invention appear in the accompanying drawings and in the specification as follows.

Figure 3:
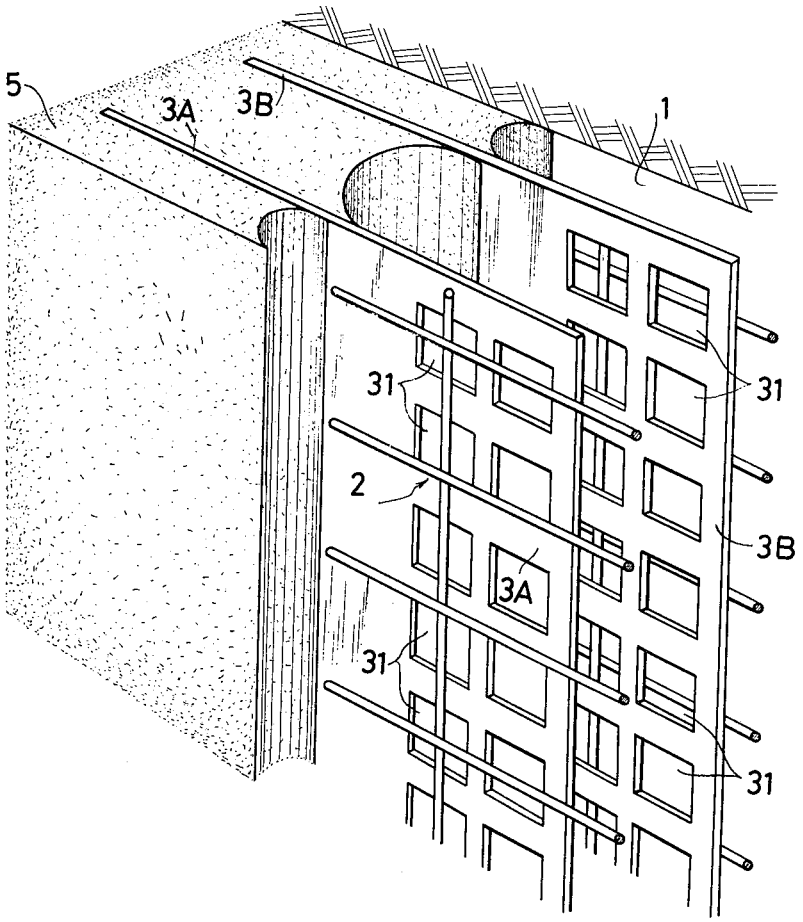
FIG. 3 is a perspective view showing a detail of the junction construction in FIG. 2.
Figure 4:
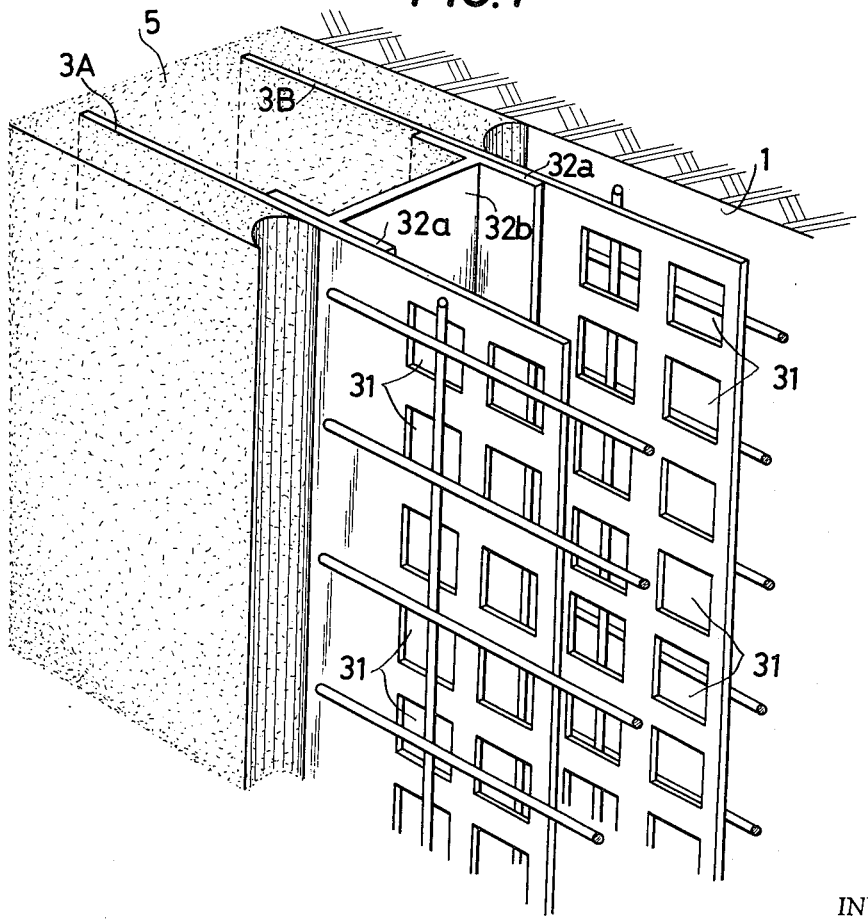
FIG. 4 is also a perspective view showing a modified embodiment of the junction construction for unit walls.
Figure 8A:
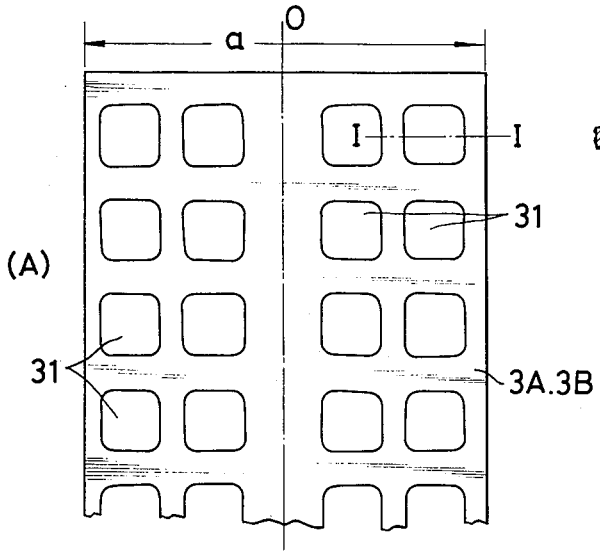
Figure 8B:
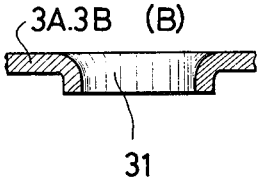
Figure 5:
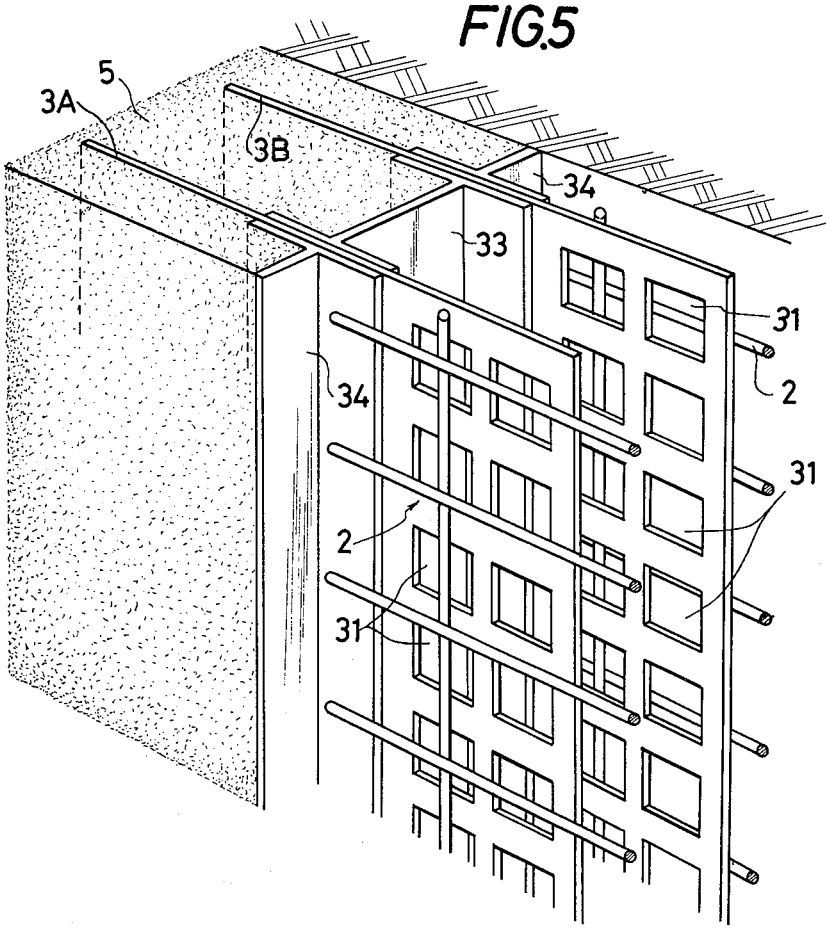
FIG. 5 is also a perspective view showing another embodiment of the bonded construction for unit walls.
Figure 9:
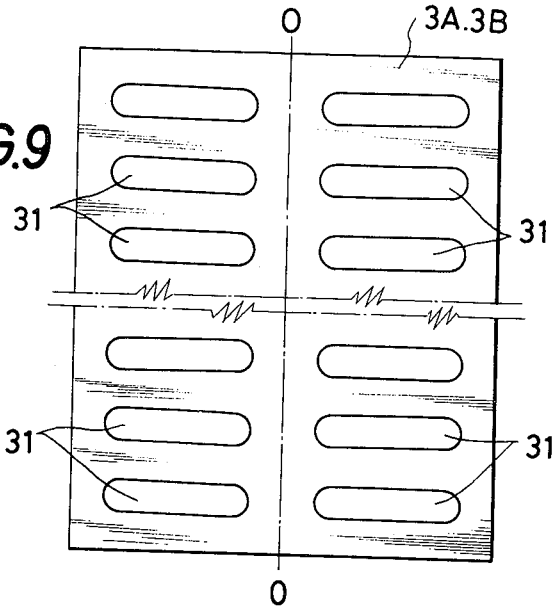
Figure 10:
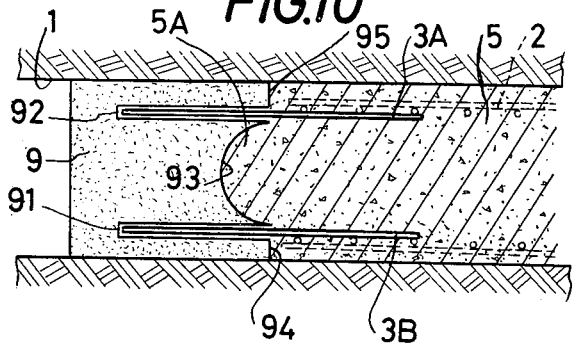
Figure 11:
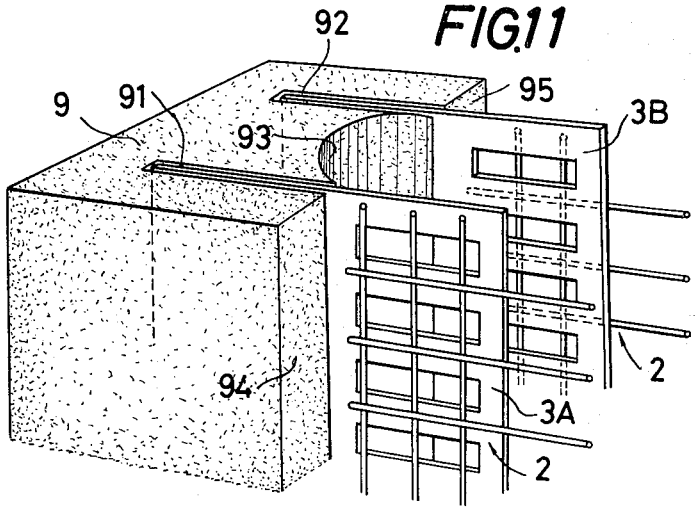
Figure 12:
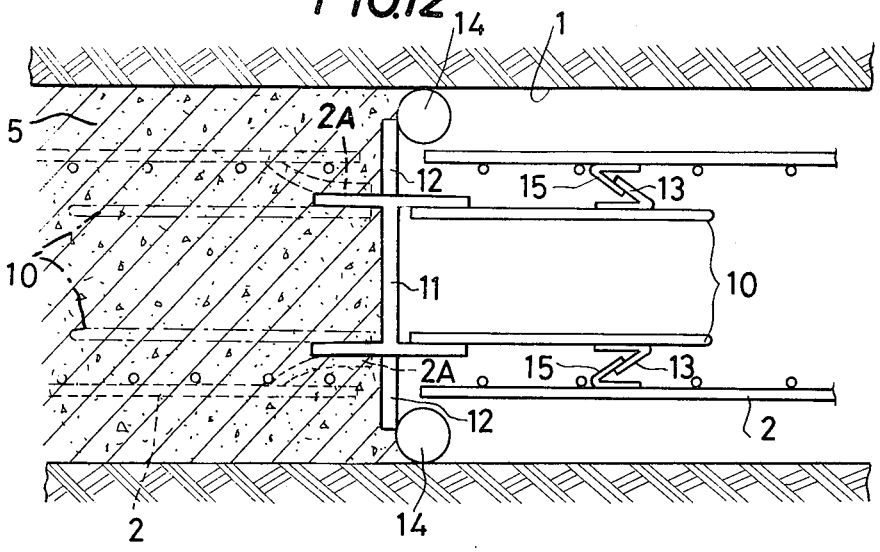
Figure 13:
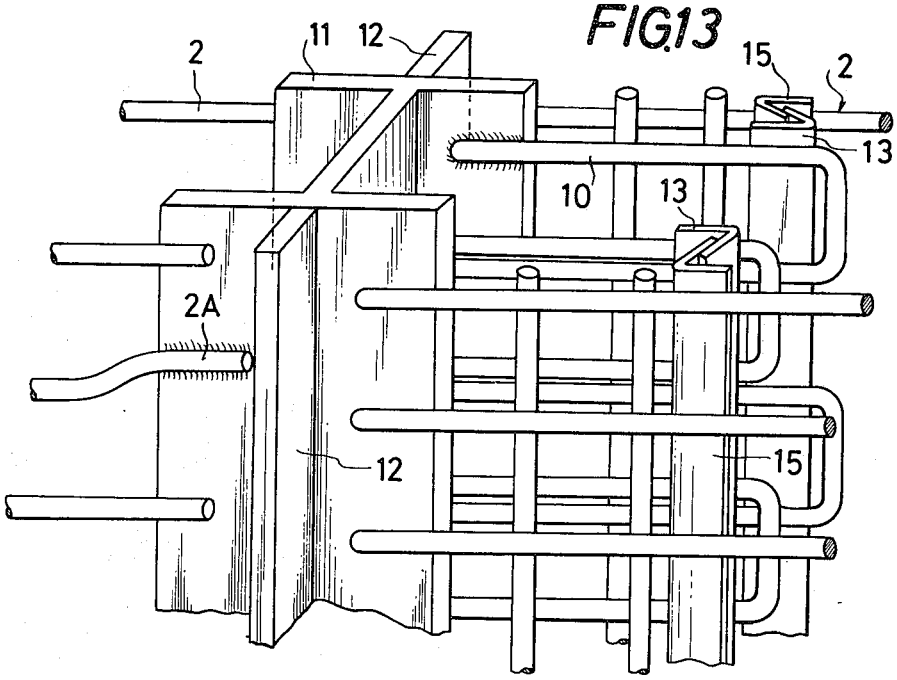
Figure 14:
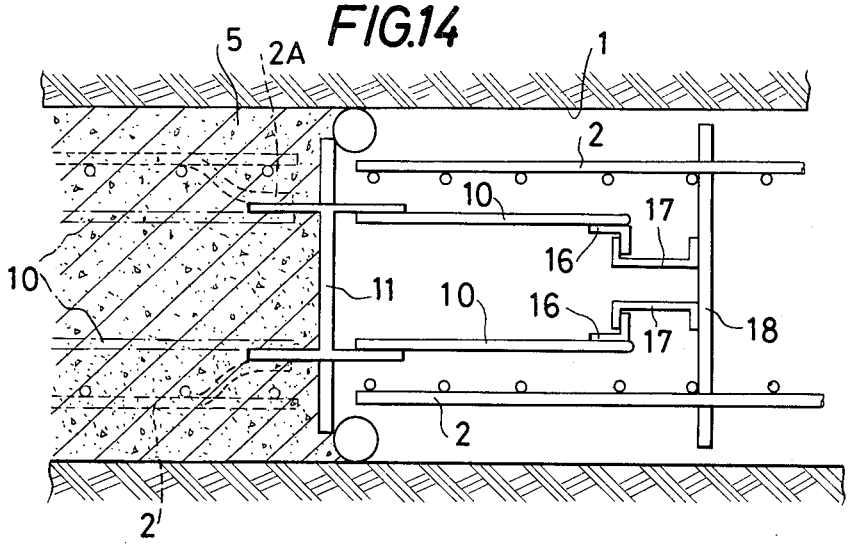
Figure 15:
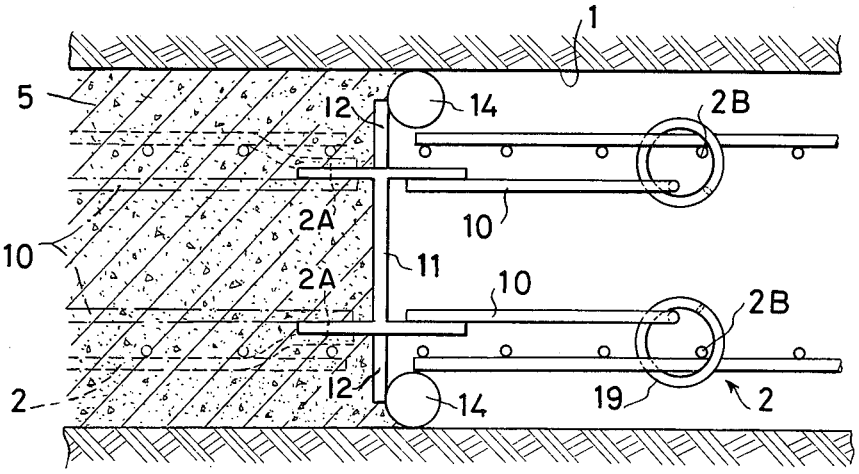
Figure 16:
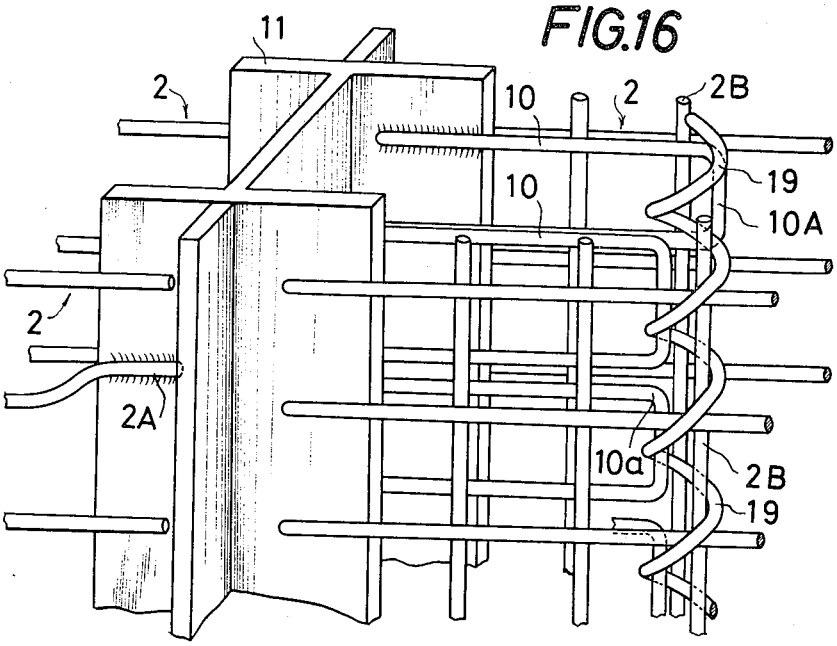
Figure 17A:
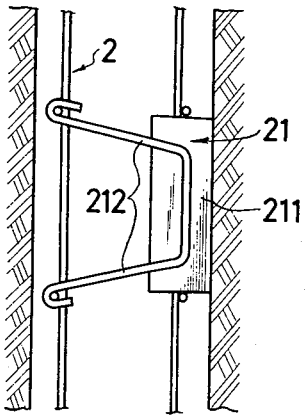
Figure 17B:
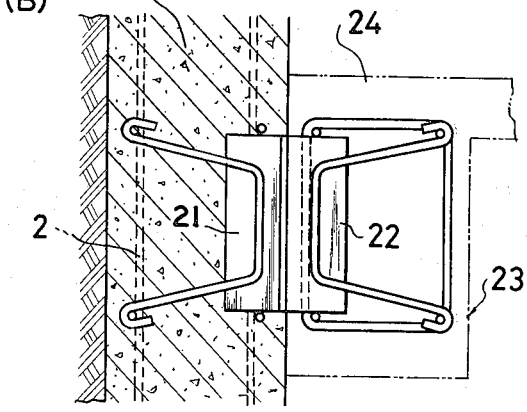

FIGS. 8*a* and 8*b* are front views of the bonding plate as shown in FIGS. 3–5 and a section of holed parts of the bonding plate, respectively;

FIG. 9 is a front view showing a modified embodiment of the bonding plate;

FIG. 10 is a plan view of the main part showing the jig means for placing the bonding plate so that it protrudes out of wall body in lieu of a locking box;

FIG. 11 is a perspective view showing a detail of the jig means;

FIG. 12 is a plan view of the main part showing means for the pressure control at the time of pouring concrete in the unit wall;

FIG. 13 is a perspective view of the main part;

FIG. 14 is a view showing a modified form of the means shown in FIG. 12;

FIG. 15 is also a view showing a modified means for the pressure control;

FIG. 16 is a perspective view of the main part of the same;

FIGS. 17*a* and 17*b* are views showing a manner of constructing columns, beams, slabs, etc. after the slurry trench wall body has been constructed;

FIG. 18 is a perspective view of a combined member utilized in the execution of the same; and FIGS. 19 through 20 are perspective views showing modified embodiments of the combined members.

Now, the present invention will be described in detail with reference to the accompanying drawings, along with embodiments.

Figure 1:
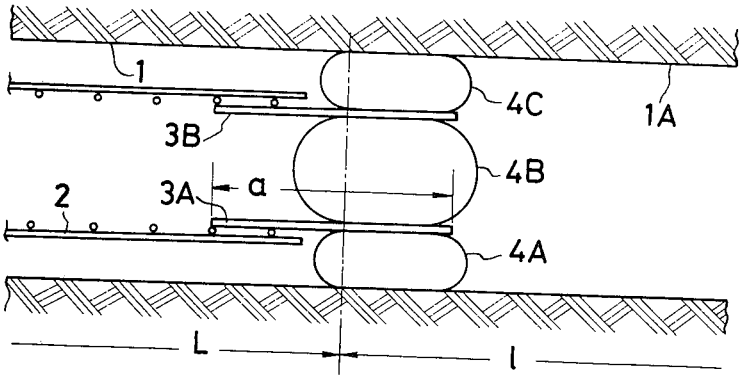
FIGS. 1 and 2 are plan views of the main part showing briefly a method of effecting the present process, particularly the construction of adjacent unit walls successively.

The process of constructing slurry trench walls in accordance with the present invention consists basically, as seen in FIG. 1, of excavating a trench or ditch 1 having a unit length by a suitable excavator, inserting a reinforcement cage 2 in trench 1, fixing the locking box, and pouring the concrete.

It is important, relative to trench 1, to take into consideration that, in addition to the basic length L corresponding to that of the unit wall, an additional portion 1A is also excavated in order to facilitate the construction of the next unit.

In order to prevent the poured concrete from flowing into the extra portion 1A, locking boxes are used which have rigid construction and into which air and/or liquid are supplied under pressure in order to expand them. The locking boxes are constructed so as to be in contact with both walls of the trench. In the present invention, two pieces of bonding plate 3A and 3B having appropriate length (a) are arranged to be secured to reinforcing cage 2. Three locking boxes 4A, 4B, and 4C having an effective length corresponding to approximately one-half of the bonding plate length are mounted in the space (or gap) defined by bonding plates 3A and 3B and trench 1 in a manner so that when the locking boxes are removed, the desired amount of bonding plates 3A and 3B will protrude out of the concrete.

Figure 2:
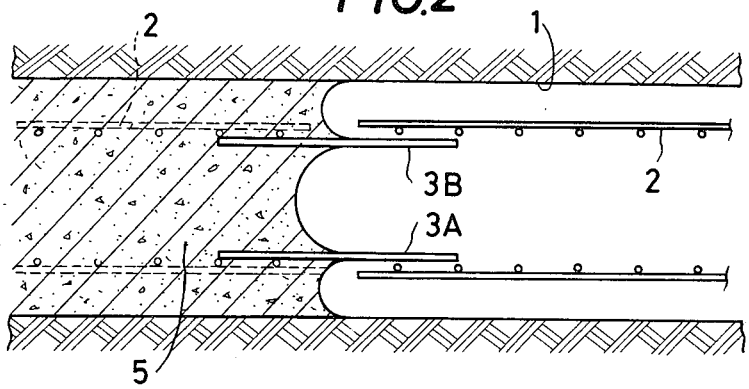

Thereafter, concrete is poured into the molded spaces sectioned and formed by these locking boxes, and when the concrete has been hardened to a sufficiently stabilized condition, the locking boxes 4A–4C are pulled out to form one unit of concrete wall body 5 as shown in FIG. 2. About half of the bonding plates 3A and 3B, corresponding to the sites of the locking boxes 4A, 4B and 4C, protrude into what will be the surface of wall body which is yet to be formed.

Then, the next unit of trench 1 is excavated, another unit of the reinforcement cage 2 is positioned in the manner previously described, overlapping bonding plates 3A and 3B are positioned, and the concrete is poured. Thus, both wall bodies may always be constructed in a tightly bonded condition through bonding plates 3A and 3B. That is, the steps shown in the description in FIGS. 1 and 2 and described above are to be effected in the same order in forming each unit wall body. The bonding plates shown are flat and it is necessary to provide means to protect against high fluid pressures since all the pressure of the poured concrete is on locking boxes 4A through 4C. As shown in FIG. 3, indicating in more detail the construction shown in FIG. 2, bonding plates 3A and 3B are provided with a number of punched holes 31. When using a muddy water process, bentonite slurry adheres to the surfaces of the reinforcing and bonding plates so that the adhesive strength of the concrete is somewhat lower. Therefore, by providing punched holes 31 in bonding plates 3A and 3B, concrete flows into the holes, when poured and fills them and, as a result, the bonding becomes stronger in shear. Thus, an increase in the bond strength to an extent corresponding to the shear strength of both materials is obtained.

FIG. 4 shows another example of construction different from that of FIG. 3. Here, an H-shaped member 32 is incorporated between bonding plates 3A and 3B, flanges 32*a* of said member are welded to the bonding members so as to form a single-body bonding structure. Thus, web 32*b* of H-shaped member 32 serves as a blockage to prevent the concrete from flowing out of the unit. In this embodiment, it is therefore unnecessary to provide locking member 4B shown in FIG. 1.

The construction of the embodiment in FIG. 5 is based on a further development of FIG. 4, wherein an H-shaped member similar to that described previously or merely a plate-shaped intermediate member 33 is inserted between bonding plates 3A and 3B arranged in parallel and the members are welded together. Further, T-shaped members 34 are located in alignment with the extended line of said intermediate member 33 and are also welded to the outside of bonding plates 3A and 3B. Thus, the need for locking boxes, as shown in FIG. 1, is removed and mounting of the bonding plates is simplified.

In the embodiment shown in FIG. 5, some problems can occur if construction is done in collapsible soil. One problem relates to stopping the concrete from flowing out of the unit. Also, in the embodiments illustrated in FIGS. 4 and 5, a difficult problem arises with respect to the pressure created at the time of pouring the concrete. These will be considered hereinafter.

Figure 6:
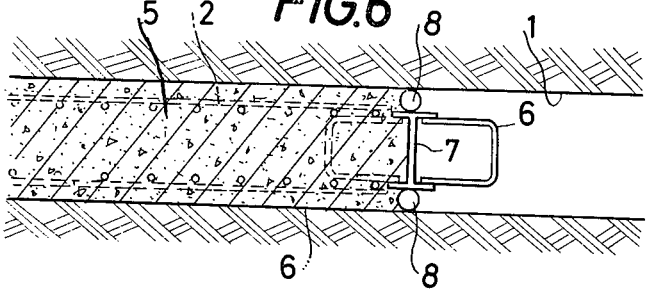
FIG. 6 is a plan view of the main part showing another embodiment also corresponding to FIG. 1.
Figure 7:
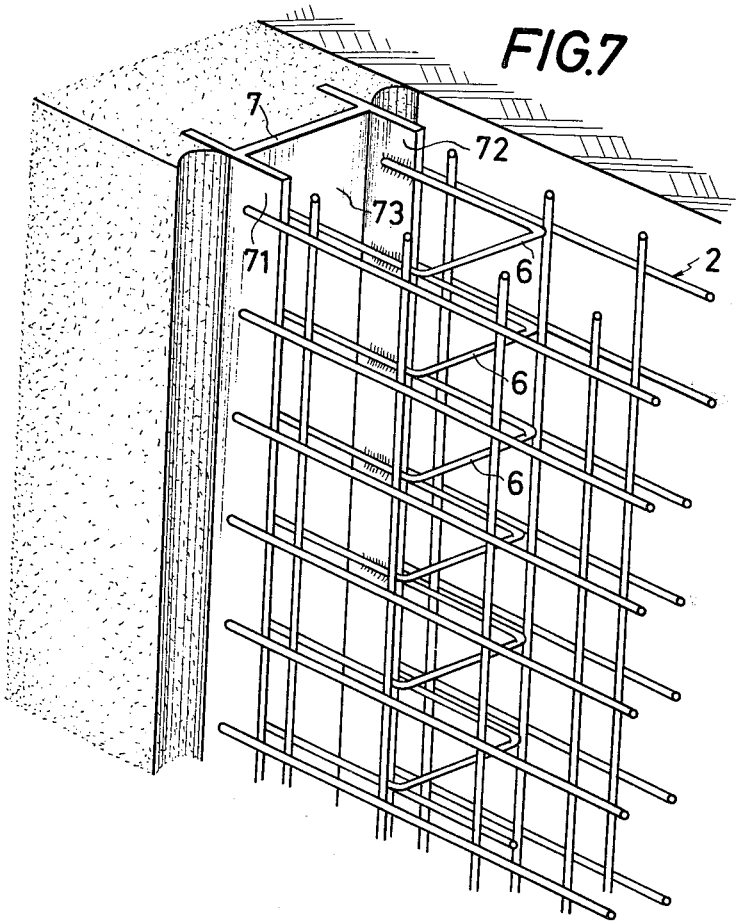
FIG. 7 is a perspective view showing a detail of the main part.

FIGS. 6 and 7 show embodiments for bonding means, in which the holed bonding plates, previously described, are not employed as a connecting members for the unit walls. That is, a number of auxiliary reinforcements 6, which are made by bending steel bars or the like to a generally rectangular or channel shape, are mounted horizontally on flanges 71 and 72 of H-shaped member 7, by welding the open ends of the auxiliary reinforcements 6 to the H shaped member. The auxiliary reinforcements are mounted on both sides of H-shaped member 7, and are provided with vertical auxiliary reinforcements at intervals connecting the auxiliary reinforcements. These auxiliary reinforcements form the protruding portion in the present embodiment.

The process of the present invention involves inserting reinforcement cage 2 in trench 1, mounting the construction body for bonding wall bodies at the rear of the cage in such an arrangement that auxiliary reinforcements 6 overlap reinforcement cage 2 and mounting locking boxes 8 which fill the space in trench 1 are mounted along the outside of flanges 71 and 72 of the H-shaped member 7. Thereafter, the concrete is poured.

According to the foregoing process, auxiliary reinforcements 6 on the outer side protrude out of the joined surfaces of completed unit wall 5. Web 73 of H-shaped member 7 serves as a stopping plate for the concrete, and the auxiliary reinforcement is buried in the poured concrete. Thus, a bonding effect, having high shear rate is produced, thereby increasing bonding strength.

FIGS. 8*a* and 8*b* and 9 show examples of bonding plates 3A and 3B in detail. The desired bonding strength relative to length *a* of the bonding plate, which is to be buried in the unit wall, can be determined by calculations using the strength required and type of construction. It has already been noted that providing punched holes 31 in the bonding plate aids in obtaining good bonding results. However, the shape, size and number of holes must be determined by considering various conditions, such as the practicality of the desired configuration, and the concrete to be used.

Considering that the purpose of providing the holes is to increase the shear ratio in bonding and understanding the previous description, there are not much difference among the rectangular holes arranged in two vertical rows, as shown in FIG. 8*a*, the unit slot-like holes, as shown in FIG. 9, and round holes. However, a symmetrical arrangement should be utilized. In view of the increase in shear ratio, if the holes are formed by means of embossing, as shown in FIG. 8*b*, the shear area is increased in an amount equal to the increase in surface area.

FIGS. 10 and 11 show embodiments using other means for positoning of the locking boxes for the purpose of providing protrusions of the bonding plate out of the surface of unit wall. That is, a rigidly constructed locking pipe 9 is used, which is a long prism body, shaped to be approximately square in cross section and having two guide grooves 91 and 92 being formed at one end surface thereof in a spaced relation equal to the parallel arrangement of the bonding plate previously described. Surface 93 between the grooves is concave and surfaces 94 and 95 on the outer sides of the grooves are flat.

Locking pipe 9, provided with the guide grooves 91 and 92 is inserted and placed firmly at the desired position in trench 1, and bonding plates 3A and 3B are mounted along the guide grooves and overlapping reinforcement cage 2. Thereafter, the concrete is poured. Locking pipe 9 is pulled out after the concrete has hardened and stabilized sufficiently to hold its shape. Since the locking pipe also serves as a stopping plate for the concrete, only the portions of bonding plates 3A and 3B which have been positioned within the guide grooves protrude out of the surface of the wall body. In addition, a corner portion 5A, which corresponds to the concave surface portion 93 of the locking pipe, may be formed in the end of the wall body. This will be a scarf construction between the concave and convex portions in bonding with the wall body of the next unit. Also, it provides excellent shear strength against forces applied in a direction perpendicular to the side of the wall body, for example, natural ground pressure. It is easy to overcome the pressure of the unset concrete with locking pipe 9; however, the material used in the pipe cannot be of a type which adheres to concrete or a mold release agent or the like must be used.

Further, there is another means for controlling the fluid pressure effectively. In one example of the locking boxes, which provides protruding bonding plates, a combination of two locking chambers having wedge-like cross sections, and one locking guide is used. By using the respective sloped surfaces of the wedges, part of the concrete pressure is converted into a normal component against the wall surface of a groove on the outer side of the chambers. A means to achieve the aforesaid purpose is the erection of a main column in the central part of the trench where the concrete is to be poured. Auxiliary columns having a groove erected at both sides of the main column to increase its rigidity, and a lengthy bag into which gas or liquid may be sealed is inserted between the auxiliary columns and wall surface of the groove. These units prevent the unset concrete from escaping the unit wall.

FIGS. 12 to 16 show effective means for controlling the pressure produced at the time of concrete pouring. In the construction illustrated in FIGS. 12 and 13, the structure for bonding wall bodies is such that a large number of auxiliary reinforcements 10, made by bending, e.g., steel bars, etc. in a rectangular shape, are prepared.

The reinforcements are arranged along the flanges on the both sides of H-shaped member 11, and the open ends of the reinforcements are secured at regular vertical intervals to member 11. The structure is assembled after being fixed by utilizing a part of transverse bracing member 2A, at the rear of a previously prepared reinforcing cage 2. Cross boards 12 are fixed along the space between the flanges of H-shaped member 11 and trench 1 so as to block concrete flow. Members 13 having a V- or similar shape in cross section and directing their open surfaces toward the next previous unit wall, are mounted vertically along auxiliary reinforcements 10 which protrude into the space provided for the next unit wall.

The unit wall on the left side in FIG. 12, which is to be the unit wall body 5, may be constructed in such a manner that reinforcing cage 2 is inserted at the rear of the structure used for bonding. The structure contains an H-shaped member 11, auxiliary reinforcements 10, cross boards 12, and V-shaped members 13. Also, the spaces between the cross boards 12 and the trench walls are closed by suitable locking boxes 14 and then concrete is poured. Then, trench 1 for the next unit is excavated, and similar reinforcing cage 2 is inserted to construct the next wall body. V-shaped members 15, which are similar to V-shaped members 13, are mounted on auxiliary reinforcing 10 protruding from the joined surface of the wall body previously constructed and are mounted at the end adjacent the previously poured unit so as to be attached to members 13. Thereby, reinforcing cage 2 may be mounted extremely precisely and maintains its correct posture as well as forming a firm connection between the reinforced cages themselves.

It is natural that a major part of the concrete pressure is on H-shaped member 11 and cross boards 12 being fixed at the rear end of the reinforcing cage. However, with the construction mentioned above, the load is transmitted from the reinforcing cage 3 to stabilized wall body 5 and reinforcing cage 2 of the unit constructed previously. This is effected through members 13 and 15. Therefore, it is not necessary to set locking boxes deeper into place, as in conventional processes, nor to make other adjustments such as back filling on the opposite side. As for the locking boxes 14, they need not be formed of the rigid construction hitherto utilized, but may be of such construction so as to merely to prevent the concrete from escaping. Of course, bonded construction of concrete wall bodies is greatly affected by the existence of auxiliary reinforcing members 10 result in bonding of greater strength with high shear ratios.

FIG. 14 is a modified mode of bonding construction also directed to the effective disposition of fluid pressure. Angle members 16, which protrude into the spaces between the wall bodies of the next unit, are used and are attached to auxiliary reinforcement members 10. Channels 17 combine with angle members 16 and a hairpin-like bracing member 18 is mounted at the front end of reinforcing cage 2 of the next unit facilitate combining the members.

FIGS. 15 and 16 show another embodiment directed to the disposition of the pressure. It is arranged so that auxiliary reinforcing members 10 protrude from the surface of previous unit wall 5. Pitch of spiral wire 19 is precisely determined and is equal to that of the transverse bracing member in reinforcing cage 2 of the next unit. Vertical members 10A, for the individual auxiliary reinforcing 10, are mounted so as to be aligned vertically. On the other hand, spiral wires are prepared which have suitable diameters and leads and are formed of steel bar or the like. The reinforcing cage 2 of the next unit overlaps auxiliary reinforcing 10 and optional longitudinal bracing member 2B is parallel to vertical members **10*a* of auxiliary reinforcing 10**. Both of these are bonded by revolving the wire from the upper side while using suitable feed pressure to cause entangling. Thereby, fluid pressure control, as well as the firm boding of the unit walls, can be achieved.

In each embodiment illustrated in FIGS. 12 through 16, as long as the transverse bracing members are firmly and strongly welded to the H-shaped member at rear end of each reinforcing cage, it is not necessary to provide auxiliary reinforcing on the side previously prepared, and the provision of said reinforcing may be omitted except for the auxiliary reinforcing protruding towards the space for the wall body of the next unit.

FIGS. 17*a* and 17*b* illustrate means for easily and strongly mounting beams, slabs, columns, etc., to be constructed in one body, by bonding them to slurry trench walls or similar concrete structures which have been constructed by the previous described process. In the case of a concrete structure which is to extend vertically from the surface of the main concrete structure, the bonding strength for both structures are very important. If the strength is not high enough, it has been considered unsafe. In order to overcome such difficulties, procedures such as providing reinforcing extending to the surface of the previous structure, or chipping off the surface of the structure have been tried. However, these were not sufficient.

According to the proposed means, as illustrated in FIG. 18, a pair of combined units are used. One of which is a combined unit 21 wherein plate 212 is welded perpendicular to the back surface of front surface plate 211. Plate 211 is of any desired size and plate 212 is welded to bar-like connecting arm 213, the extreme ends of which are folded back to shape "hooks" 213A. Another means is a combined unit wherein a bar-like connecting arm 222, the extreme ends of which are merely folded back to shape hooks 222A, is welded to plate 223.

The above may be used in the following manner: first, as shown in FIG. 17*a*, when other units are scheduled to be built after the slurry trench walls or general construction walls, the front surface of plate 211 of combined unit 21 is mounted so as to fit into the wall surface of trench 1 at the required position of reinforcing cage 2. Both of these are fixed by means of welding or the like. Then, after the concrete has hardened to the desired strength, the ground inside the wall body is excavated. Naturally, front surface plate 211 of the combined unit 21 is exposed to the surface of the concrete construction 5. Reinforcing cage 23 is installed so that plate 223 of combined unit 22, directing its front end surface outwards, is mounted in advance on reinforcing cage 23 for construction. Front surface plate 211 and plate 223 face each other and are butt-welded. Thereafter, the concrete is poured so that the desired concrete construction may be correctly and strongly built and be a single unit with wall 5.

FIG. 19 illustrates another embodiment of the aforesaid combined unit. It comprises a pair of bonding bodies, one of which is a bonding body 25 constructed in such that an angle steel member 252 is perpendicularly welded to one side of flat plate 251. Connecting arms 253, the extreme ends of which are folded back to shape hooks 253A, are welded along angle steel member 252. The other unit bonding body 26 is constructed in such a manner that connecting arms 262, the extreme ends of which are folded back to shape hooks 262A, are merely welded on angle steel member 261 in a lengthwise direction. In the unit executed in advance, the surface of flat plate 251 is positioned so that it is exposed after wall forming, and angle steel member 261 is placed by hooks 262A on hooks 253A and welding is done so as to effect bonding.

FIG. 20 also illustrates another embodiment. This is the simplest construction and uses web 271 of T-shaped member 27, having a punched hole 272 provided to effect strong bonding with the concrete. Flange 273 is made so as to effect bonding by means of welding to member 28. Member 28 is flat and has punched hole 281.

It is claimed:

1. A process for the sequential segmental construction of a reinforced concrete unit comprising sequentially: (1) preparing a trench of dimensions at least equal to a selected portion of the total section to be constructed and having a length greater than an incremental segment to be constructed; (2) positioning a primary segment reinforcing cage in said trench; (3) positioning intersegmental perforate plate reinforcing partially overlapping said primary segment reinforcing cage; (4) positioning sealing means to define a segmental volume from which said plate reinforcing partially protrudes and effective to prevent concrete from flowing out of said segmental volume; and (5) pouring concrete into said segmental volume.

2. The process for the sequential segmental construction of a reinforced concrete unit comprising sequentially 1. preparing a trench of dimensions at least equal to a selected portion of the total section to be constructed and having a length greater than the incremental segment to be constructed;
2. positioning a primary segment reinforcing cage in said trench;
3. positioning intersegmental perforate plate reinforcing partially overlapping said primary segment reinforcing cage;
4. positioning plural inflatable sealing means adjacent the ends of said cage to define a segmental volume from which said plate reinforcing partially protrudes; and
5. inflating said inflatable sealing means so that said sealing means are effected to prevent concrete from flowing out of said segmental volume; and
6. pouring concrete into said segmental volume.

* * * * *